US007506867B2

(12) United States Patent
Lee et al.

(10) Patent No.: US 7,506,867 B2
(45) Date of Patent: Mar. 24, 2009

(54) PAPER FEEDING DEVICE

(75) Inventors: Yueh-Shing Lee, Hsinchu (TW); Kuo-Kuang Wu, Hsinchu (TW); De-You Chu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 0 days.

(21) Appl. No.: 11/696,544

(22) Filed: Apr. 4, 2007

(65) Prior Publication Data

US 2008/0246210 A1 Oct. 9, 2008

(51) Int. Cl.
*B65H 3/06* (2006.01)

(52) U.S. Cl. ..... 271/117; 271/118

(58) Field of Classification Search ..... 271/117, 271/118, 34

See application file for complete search history.

(56) References Cited

U.S. PATENT DOCUMENTS 6,497,405 B2 * 12/2002 Yu et al. ..... 271/116
7,252,283 B2 * 8/2007 Lan et al. ..... 271/34
7,264,240 B1 * 9/2007 Lee ..... 271/273
7,275,741 B2 * 10/2007 Worley et al. ..... 271/117

* cited by examiner

*Primary Examiner*—Kaitlin S Joerger
(74) *Attorney, Agent, or Firm*—WPAT, P.C.; Anthony King

(57) ABSTRACT

A paper feeding device comprises an upper frame, a pickup roller assembly connected to the upper frame and a lower frame. The pickup roller assembly includes a roller frame, a separating roller, a pickup roller, and a belt sleeved on both the separating roller and the pickup roller. The separating roller and the pickup roller are connected to the roller frame. The belt impels the separating roller and the pickup roller to press against the roller frame. When the separating roller rotates, the friction created between the separating roller and the roller frame and the friction created between the pickup roller and the roller frame drives the pickup roller assembly to rotate, then the paper is fed into the paper feeding device. The structure of the paper feeding device is simple and the cost is lower than the conventional one, moreover, it is convenient to assemble.

10 Claims, 5 Drawing Sheets

PAPER FEEDING DEVICE

BACKGROUND OF THE INVENTION

1. Field of the Invention

The present invention relates to a paper feeding device, and more particularly to a paper feeding device applied in a business machine.

2. The Related Art

Recent business machines, such as a scanner, a printer, a copier, etc., are broadly required in the office operation. The business machine has a paper feeding device for feeding papers into the machine.

Please refer to FIGS. 1-2, a conventional paper feeding device 1' is shown. The paper feeding device 1' is arranged between the upper frame 2' and the lower frame 3', including a separating roller 10', a pickup roller 30', a supporting portion 40' and a spring 50'. A stack of papers 4' are placed under the pickup roller 30', the supporting portion 40' connects an active shaft 12' and a conveying shaft 32'. A conveying gear 14' is located at one end of the separating roller 10' and a picking gear 34' is located at the sane end of the pickup roller 30', an idle gear 24' is placed between the conveying gear 14' and the picking gear 34' and clenches the teeth of them, the idle gear 24' is connected to a locating pillar 22'. The spring 50' is positioned between the supporting portion 40'.

Referring to FIG. 2 again, when the separating roller 10' is driven to rotate clockwise, the pickup roller 30' also rotates clockwise, then a friction created between the spring 50' and the supporting portion 40' drives the supporting portion 40' and the pickup roller 30' rotate downwards around the active shaft 12', so the pickup roller 30' contacts with the papers 4' and feed the papers 4' into the paper feeding device 1' one by one.

On the contrary, when the active shaft 12' is driven to rotate anti-clockwise, the friction created between the spring 50' and the supporting portion 40' drives the supporting portion 40' and the pickup roller 30' rotate upwards around the active shaft 12', so the pickup roller 30' departs from the papers 4', then the active shaft 12' stops, the paper feeding device 1' recovers to the nature state as shown in FIG. 1.

However, the conventional paper feeding device 1' feeds the paper 4' via the cooperation of the conveying gear 14', the picking gear 34', the idle gear 24' and the spring 50' positioned between the supporting portion 40' and the idle gear 24', as a result, the structure of the paper feeding device 1' is complex, the cost is high and it is inconvenient to assemble.

SUMMARY OF THE INVENTION

Accordingly, an object of the present invention is to provide a paper feeding device comprising an upper frame, a lower frame having a paper loading base and a pickup roller assembly picking up a sheet of paper from the paper loading base and transferring the paper. The pickup roller assembly is connected to the upper frame, having a roller frame, a separating roller, a pickup roller and a belt sleeved on both the separating roller and the pickup roller. The separating roller and the pickup roller is connected to the roller frame; the belt impels the separating roller and the pickup roller to press against the roller frame.

When the separating roller rotates, the friction created between the separating roller and the roller frame and the friction created between the pickup roller and the roller frame drives the roller frame to rotate around the active shaft, then the paper is fed into the paper feeding device. The structure of the paper feeding device is simple and the cost is lower than the conventional one, moreover, it is convenient to assemble.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
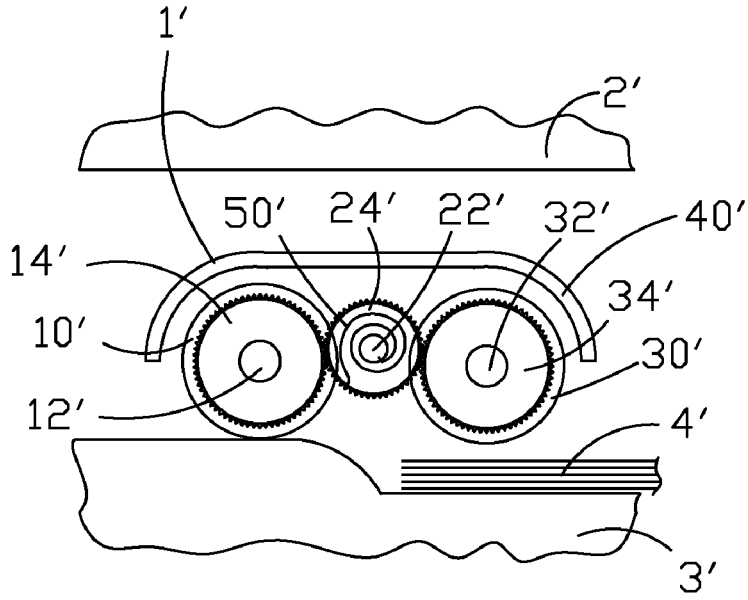
FIG. 1 (Prior Art)
FIGS. 1-2 show a conventional paper feeding device.
Figure 2:
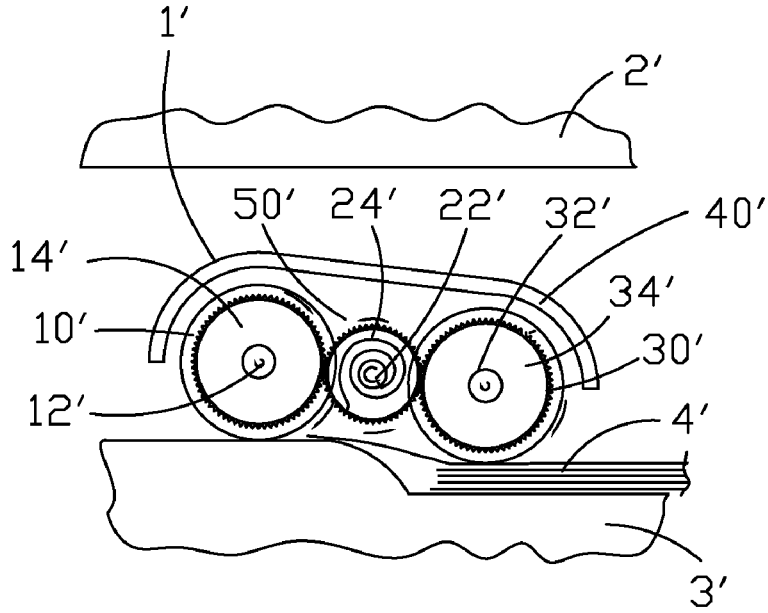
FIG. 2 (Prior Art)
Figure 3:
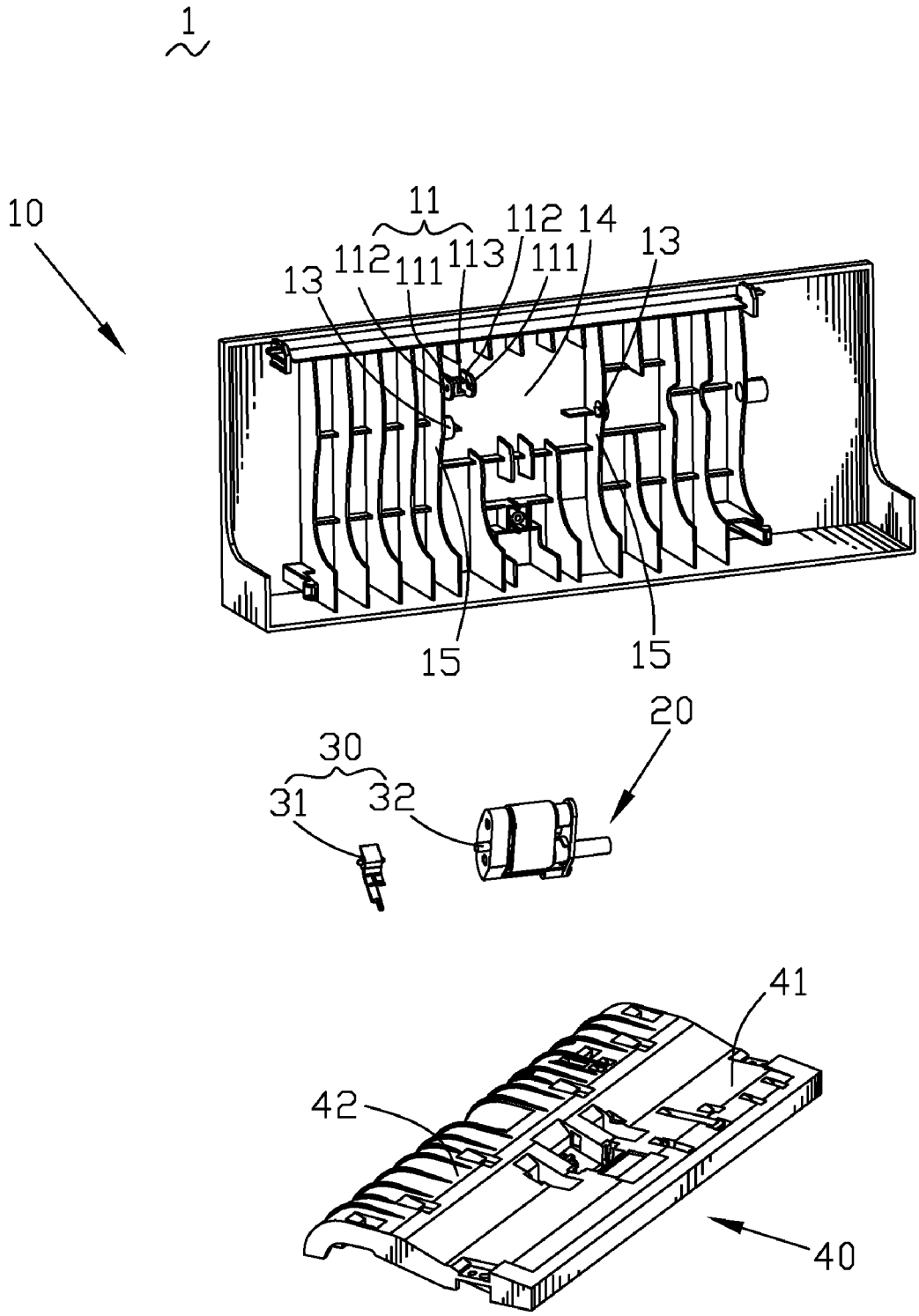
FIG. 3 is an exploded perspective view of a paper feeding device of the present invention.

Please refer to FIG. 3, the paper feeding device 1 of the present invention includes an upper frame 10, a pickup roller assembly 20, a lower frame 40 and a paper blocking apparatus 30.

The upper frame 10 and the lower frame 40 are arranged separated and form a paper transporting passage 42 (shown in FIG. 7) therebetween. A pair of connecting boards 15 project from the inner surface of the upper frame 10 and form a receiving space 14 therebetween. A retaining portion 11 is located in the receiving space 14 near the connecting board 15, the retaining portion 11 includes two retaining boards 112, a retaining hole 111 is opened in the retaining board 112, and a projection 113 is located between the two retaining boards 112. A pair of connecting portions 13 are defined in the two connecting boards 15 respectively below the retaining portion 11.

Figure 4:
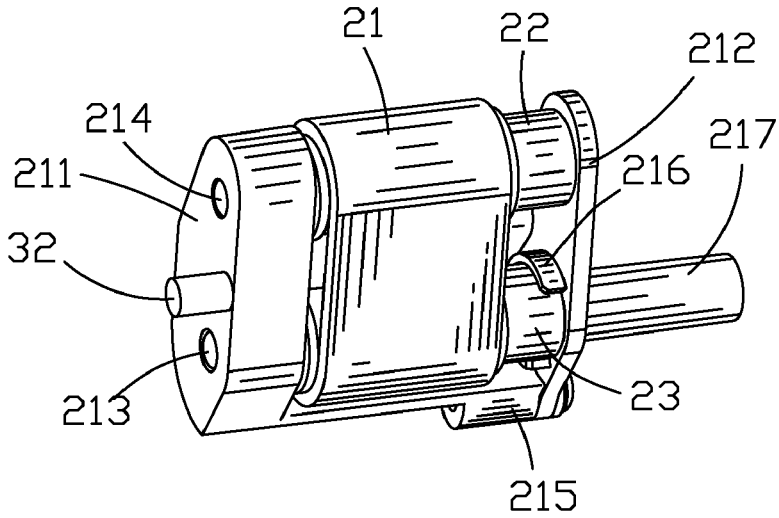
FIG. 4 is a perspective view of a pickup roller assembly of the present invention.
Figure 5:
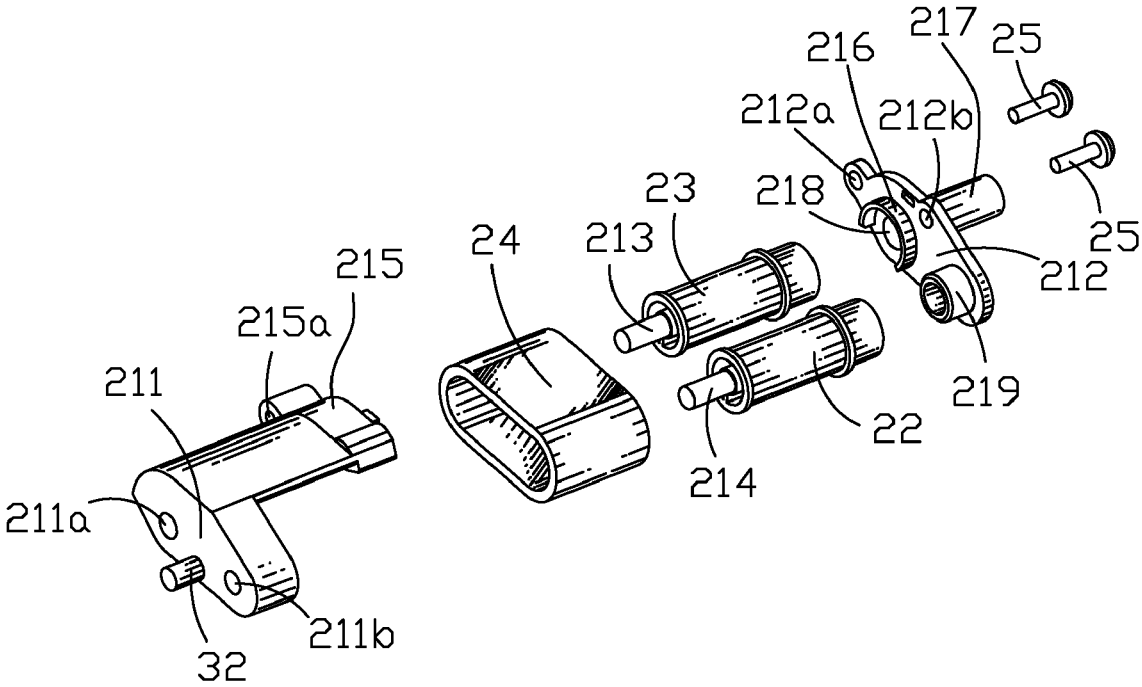
FIG. 5 is an exploded perspective view of FIG. 4.

Referring to FIGS. 4-5, the pickup roller assembly 20 includes a roller frame 21, a pickup roller 22, a separating roller 23 and a belt 24. The roller frame 21 has a first sidewall 211, a second sidewall 212, an active shaft 213 and an idle shaft 214. A first active shaft hole 211*a* and an idle shaft hole 211*b* are opened in the first sidewall 211, the rear of the first sidewall 211 extends towards the second sidewall 212 and forms a mating wall 215, two mating holes 215*a* (one mating hole is not shown) are opened in the mating wall 215. A second active shaft hole 218 opened in the second sidewall 212 corresponding to the first active shaft hole 211*a* of the first sidewall 211, a circle shaped restricting portion 216 projects from the inner surface of the second sidewall 212 around the second active shaft hole 218, and a mating tube 217 projects from the outer surface of the second sidewall 212 around the second active shaft hole 218. A sleeve portion 219 projects from the inner surface of the second sidewall 212 corresponding to the idle shaft hole 211*b* of the first sidewall 211, two connecting holes 212*a* are opened in the second sidewall 212 corresponding to the two mating holes 215*a* of the mating wall 215. One end of the active shaft 213 is connected to the first active shaft hole 211*a*, one end of the idle shaft 214 is connected to the idle shaft hole 211*b*.

A separating roller 23 is located around the active shaft 213 and a pickup roller 22 is located around the idle shaft 214. One end of the separating roller 23 is inserted into the restricting portion 216 of the second sidewall 212, one end of the pickup roller 22 is sleeved on the sleeve portion 219 of the second sidewall 212. A belt 24 is sleeved on both the separating roller 23 and the pickup roller 22, and impels the separating roller 23 and the pickup roller 22 to press against the roller frame 21, so when the separating roller 23 rotates, a friction created between the separating roller 23 and the restricting portion 216 and a friction created between the pickup roller 22 and the sleeve portion 219 drive the roller frame 21 to rotate around the active shaft 213.

Figure 6:
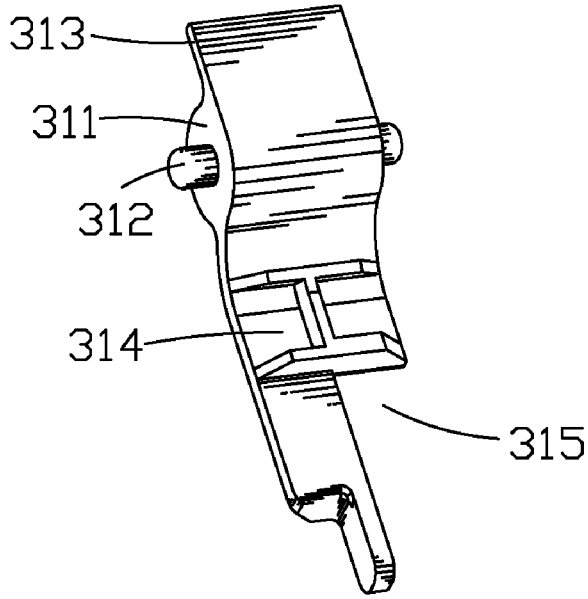
FIG. 6 is a perspective view of a blocking element shown in FIG. 3.

Please refer to FIG. 3 and FIG. 6, the paper blocking apparatus 30 includes a blocking element 31 and a blocking projection 32. The blocking element 31 has a connecting portion 311, two opposite sides of the connecting portion 311 project to form a positioning pillar 312. A front end of the connecting portion 311 extends upward to form a restricting arm 313, the restricting arm 313 leans against the projection 113 of the upper frame 10. The back end of the connecting portion 311 extends downwards and forms a stopping portion, the stopping portion further extends downwards to form a blocking arm 314, one part of the blocking arm 314 is cut off and defines an opening 315 communicating the bottom and the right side of the blocking arm 314. The blocking projection 32 is mounted on the first sidewall 211 of the pickup roller assembly 20.

The assemblage of the paper feeding device 1 of the present invention is described in detail hereinafter. Please refer to FIGS. 4-5, firstly, the belt 24 is sleeved on both the pickup roller 22 and the separating roller 23. Then one end of the active shaft 213 is connected to the first active shaft hole 211*a*, one end of the idle shaft 214 is connected to the idle shaft hole 211*b*, next, one end of the separating roller 23 is inserted into the restricting portion 216 of the second side wall 212, one end of the pickup roller 22 is sleeved on the mating tube 217 of the second side wall 212, then a connecting component, such as a screw 25, is located in each of the connecting holes 212*a* and the corresponding mating hole 215*a* for connecting the second sidewall 212 to the first side wall 211, then the pickup roller assembly 20 is assembled.

Figure 7:
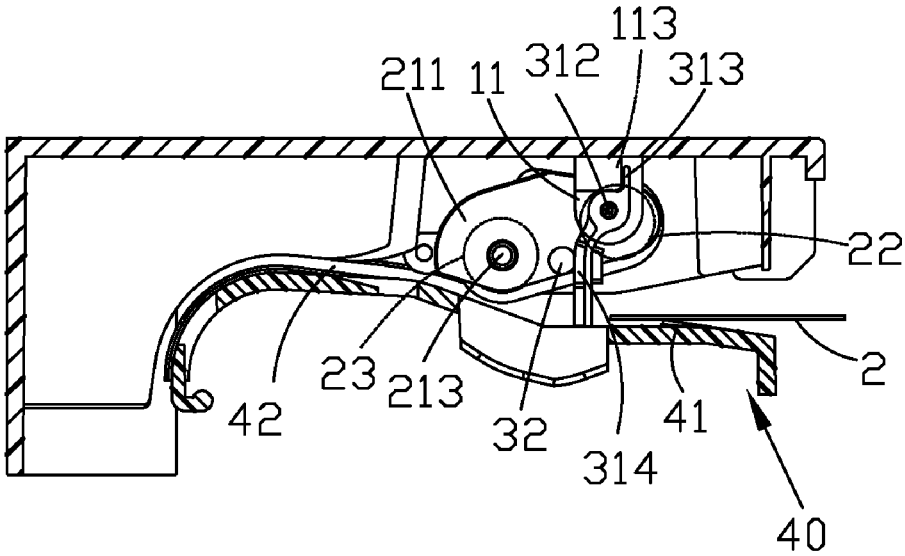
FIGS. 7-9 show the act process of the paper feeding device of the present invention.

Please refer to FIG. 3 and FIG. 7, secondly, the left end of the active shaft 213 and the mating tube 217 are rotatablely connected to the connecting portions 13 of the upper frame 10, the pickup roller assembly 20 is received in the receiving space 14 therein. Then please refer to FIG. 6, the paper blocking apparatus 30 is placed beside the pickup roller assembly 20, in this embodiment, the paper blocking unit 30 is placed at the left side of the pickup roller assembly 20, and the positioning pillar 312 of the blocking element 31 is rotatablely connected to the retaining hole 111 of the upper frame 10, the blocking projection 32 stops at the upper portion of the blocking element 31. Lastly, the upper frame 10 covers on the lower frame 40, the paper feeding device 1 of the present invention is assembled.

As shown in FIG. 7, a paper loading base 41 is formed at the front portion of the lower frame 40 for loading the papers 2 outside. When the paper feeding device 1 is in natural state, the pickup roller 22 keeps a certain distance from the papers 2, the blocking projection 32 stops at the blocking arm 314, the restricting arm 313 is stopped at the projection 113, the papers 2 are stopped outside by the blocking arm 314.

Figure 8:
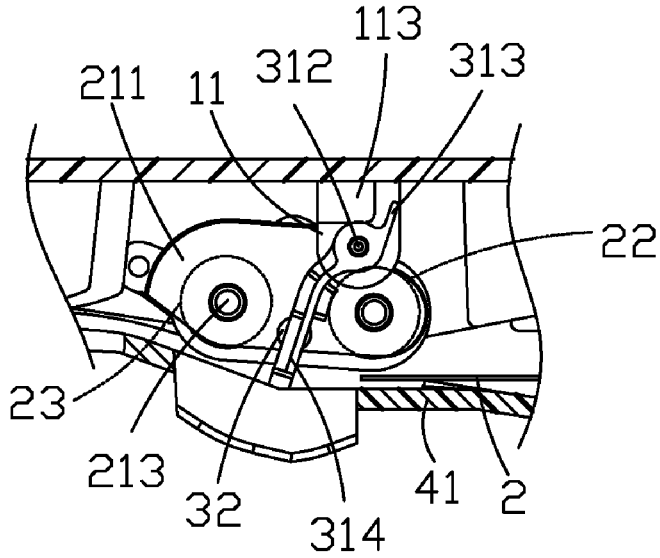
Figure 9:
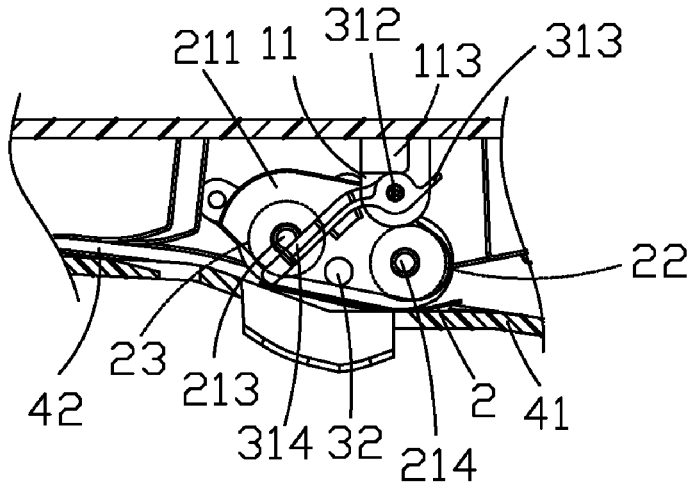

Please refer to FIGS. 8-9, when the paper feeding device 1 picks up the paper 2 loaded on the paper loading base 41, the active shaft 213 is driven to rotate clockwise, so the separating roller 23 mounted on the active shaft 213 rotates clockwise as well, a friction created between the separating roller 23 and the belt 24 drives the belt 24 to move along with the separating roller 23, then a friction created between the belt 24 and the pickup roller 22 drives the pickup roller 22 to rotate clockwise. As the pickup roller 22 and the separating roller 23 both press against the roller frame 21, when the pickup roller 22 and the separating roller 23 rotate clockwise, a friction created between the separating roller 23 and the restricting portion 216 and a friction created between the pickup roller 22 and the sleeve portion 219 drives the pickup roller assembly 20 to rotate anti-clockwise around the active shaft 213 and move downwards, then the pickup roller 22 contacts with the paper 2. Meanwhile, as the pickup roller assembly 20 moves downwards, the blocking projection 32 mounted on the first sidewall 211 also moves downwards and passes through the opening 315 of the blocking element 31, so the blocking projection 32 loses the cooperation with the blocking arm 314, the blocking arm 314 rotates clockwise around the positioning pillar 312 and is no longer stop the papers 2. Then as the belt 24 contacts with the paper 2 and rotates clockwise, the friction created therebetween picked the paper 2 into the paper transporting passage 42.

On the contrary, when the picking up device 1 stops to pick papers 2, the active shaft 213 is instantly driven to rotate anti-clockwise, then the separating roller 23 rotate anti-clockwise and the belt 24 drives the pickup roller 22 also to rotate anti-clockwise. As the friction created between the separating roller 23 and the restricting portion 216 and the friction created between the pickup roller 22 and the sleeve portion 219 drives the pickup roller assembly 20 to rotate anti-clockwise around the active shaft 213 and move upwards, the pickup roller 22 departs from the papers 2. The blocking arm 314 rotates anti-clockwise around the positioning pillar 312 under its own weight, meanwhile, the blocking projection 32 mounted on the pickup roller assembly 20 passes through the opening 315 (shown in FIG. 6) of the blocking element 31 and then stops at the blocking arm 314, the restricting arm 313 stops at the projection 113 of the upper frame 10, then the pickup roller assembly 2223 stop to rotate, as shown in FIG. 7, the paper feeding device 1 is in natural state, the papers 2 are stopped outside by the blocking arm 314.

As described above, the belt 24 sleeved on both the separating roller 23 and the pickup roller 22 impels the separating roller 23 and the pickup roller 22 to press against the roller frame 21, so when the separating roller 23 rotates, the friction created between the separating roller 23 and the restricting portion 216 and the friction created between the pickup roller 22 and the sleeve portion 219 drives the pickup roller assembly 20 to rotate around the active shaft 213, then the paper 2 is fed into the paper feeding device 1. As a result, the structure of the paper feeding device 1 is simple and the cost is lower than the conventional one, moreover, it is convenient to assemble.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A paper feeding device driven to pick up a sheet of paper and transfer the paper thereof, comprising:

an upper frame;

a lower frame assembled with the upper frame; and a pickup roller assembly located between the upper frame and the lower frame for picking up and transferring the paper, having a roller frame connected to the upper frame, having a first sidewall, a second sidewall located apart from and substantially parallel to the first sidewall, an active shaft hole opened on the first sidewall, an idle shaft hole opened on the first sidewall, a restricting portion projected from the second sidewall, towards the first sidewall and corresponding to the active shaft hole of the first sidewall, a sleeve portion projected from the second sidewall, towards the first sidewall and corresponding to the idle shaft hole, a separating roller located between the first sidewall and the second sidewall, an active shaft projected from one lateral side portion of the separating roller and engaging into the active shaft hole of the first sidewall, the other lateral side portion of the separating roller coupled with the restricting portion of the second sidewall, a pickup roller located apart from the separating roller, the pickup roller located between and coupled with the first sidewall and the second sidewall, an idle shaft projected from one lateral side portion of the pickup roller and engaged into the idle shaft hole of the first sidewall, the other lateral side portion of the pickup roller coupled with the sleeve portion of the second sidewall, and a belt sleeved on both the separating roller and the pickup roller;

wherein the active shaft is impelled to abut against an inner surface of the active shaft hole of the first sidewall by the belt the other lateral side portion of the separating roller is impelled to abut against the restricting portion of the second sidewall by the belt, the idle shaft is impelled to abut against an inner surface of the idle shaft hole by the belt, and the other lateral side portion of the pickup roller is impelled to abut against an sleeve portion of the second sidewall by the belt;

before the pickup roller is driven to contact with the paper, the friction created between the active shaft and the inner surface of the active shaft hole and the friction created between the other lateral side portion of the separating roller and the restricting portion of the second sidewall are resisting a driving force, hence to swing pivotally the pickup roller assembly about the separating roller and the active shaft;

while the pickup roller is driven to swing towards the paper and contact with the paper, the driving force urges the active shaft to rotate relative to the active shaft hole of the first sidewall, and urges the other lateral side portion of the separating roller to rotate relative to the restricting portion of the second sidewall, a rotation of the separating roller urges the belt to run endlessly around the separating roller and the pickup roller, a run of the belt urges the pickup roller to rotate relative to the first sidewall and the second sidewall, the rotation of the pickup roller urges the paper to be fed towards the separating roller.

2. The paper feeding device as claimed in claim 1, wherein a pair of connecting portions are projected from an inner surface of the upper frame and towards the lower frame for connecting the roller frame of the pickup roller assembly.

3. The paper feeding device as claimed in claim 2, wherein a pair of connecting boards are projected from the inner surface of the upper frame, a receiving space is penetrated through the upper frame and formed between the pair of connecting boards for receiving the pickup roller assembly, a pair of connecting portions are formed on the pair of connecting boards respectively.

4. The paper feeding device as claimed in claim 1, wherein a rear portion of the first sidewall is extended towards the second sidewall and formed a mating wall, at least one mating hole is opened on the mating wall, a connecting hole is opened on the second sidewall corresponding to the mating hole, a connecting component is located into the connecting hole and the mating hole for connecting the second sidewall to the matching wall of the first sidewall.

5. The paper feeding device as claimed in claim 1, wherein the restricting portion is formed as an arc-shaped.

6. The paper feeding device as claimed in claim 1, wherein the other lateral side portion of the separating roller abuts against an inner surface of the restricting portion, the other lateral side portion of the pickup roller abuts against an outer surface of the sleeve portion.

7. A pickup roller assembly for picking up and transferring a sheet of paper, comprising:

a roller frame having a first sidewall, a second sidewall located apart from and parallel to the first sidewall, an active shaft hole penetrated through the first sidewall, and an idle shaft hole penetrated through the first sidewall and formed apart from the active shaft hole, a restricting portion projected from the second sidewall, towards the first sidewall, a sleeve portion projected from the second sidewall, towards the first sidewall;

a separating roller;

a pickup roller located apart from the separating roller;

an active shaft projected from one lateral side portion of the separating roller and engaged into the active shaft hole of the first sidewall, the other lateral side portion of the separating roller coupled with the restricting portion of the second sidewall;

an idle shaft projected from one lateral side portion of the pickup roller and engaged into the idle shaft hole of the first sidewall, the other lateral side portion of the pickup roller coupled with the sleeve portion of the second sidewall; and a belt sleeved on both the separating roller and the pickup roller;

wherein the idle shaft is impelled to abut against an inner surface of the idle shaft hole by the belt, and the active shaft is impelled to abut against an inner surface of the active shaft hole by the belt;

before the pickup roller is driven to contact with the paper, a friction created between the active shaft and the inner surface of the active shaft hole and the friction created between the other lateral side portion of the separating roller and the restricting portion are resisting a driving force, hence to swing pivotally the pickup roller assembly about the separating roller and the active shaft;

while the pickup roller is driven to swing towards the paper and contact with the paper, the driving force urges the urges the separating roller to rotate relative to the first sidewall and the second sidewall, a rotation of the separating roller urges the belt to run endlessly around the separating roller and the pickup roller, a run of the belt urges the pickup roller to rotate relative to the first sidewall and the second sidewall, the rotation of the pickup roller urges the paper to be fed towards the separating roller.

8. The pickup roller assembly as claimed in claim 7, wherein the other lateral side portion of the separating roller abuts against an inner surface of the restricting portion, the other lateral side portion of the pickup roller abuts against an outer surface of the sleeve portion.

9. The pickup roller assembly as claimed in claim 7, wherein the restricting portion is formed as an arc-shaped.

10. The pickup roller assembly as claimed in claim 7, wherein a mating wall is extended from the first sidewall and toward the second sidewall, the mating wall is substantially perpendicular to the first sidewall and the second sidewall, at least one mating hole is opened on a free end portion of the mating wall, a connecting hole is opened on the second sidewall and aligned with the mating hole, a connecting component is engaged into the connecting hole and the mating hole for connecting the second sidewall to the mating wall of the first sidewall.

* * * * *